United States Patent [19]

Huang

[11] Patent Number: 5,058,629

[45] Date of Patent: Oct. 22, 1991

[54] SLEY FOR A MAGNETIC SHUTTLE

[76] Inventor: Chi-Shuang Huang, No. 23, Lane 235, Kai-San Rd., Tainan, Taiwan

[21] Appl. No.: 530,262

[22] Filed: May 30, 1990

[51] Int. Cl.[5] ..... D03D 49/44

[52] U.S. Cl. ..... 139/134; 139/188 R; 139/197

[58] Field of Search ..... 139/134, 133, 142, 196.1, 139/188 R, 197

[56] References Cited

U.S. PATENT DOCUMENTS 2,713,876 7/1955 Walton ..... 139/134
4,901,768 2/1990 Chi-Shuang ..... 139/143

FOREIGN PATENT DOCUMENTS 9907 of 1899 United Kingdom ..... 139/134

*Primary Examiner*—Andrew M. Falik
*Attorney, Agent, or Firm*—Lackenbach Siegel Marzullo & Aronson

[57] ABSTRACT

A sley for a loom has a slot in which the magnet of a shuttle and/or the magnet of a magnetic force-generating device extends, so as to minimize the distance between the magnets of the shuttle and the magnetic force-generating device. This results in an increase in the magnetic force of attraction without having to use a higher power magnetic force generating device. Further, the shuttle is synchronized with a shuttle driving member of the magnetic force-generating device.

2 Claims, 3 Drawing Sheets

SLEY FOR A MAGNETIC SHUTTLE

BACKGROUND OF THE INVENTION

This invention relates to a sley for a magnetically controlled loom which can increase the magnetic attractive force to drive a shuttle.

Normally, the sley of a magnetically controlled loom has a thin upper wall. A shuttle flies intermediately above the upper wall, while a magnetic force-generating means moves intermediately under the upper wall so as to attract and drive the shuttle to fly. The magnetic force-generating means is provided with a magnetic force-generating element, such as a magnet. The magnetic force-generating element must be spaced from the upper wall at a safe distance so as to avoid collision with the upper wall. Consequently, the shuttle is space from the magnetic force-generating element at a distance which is the sum of the thickness of the upper wall and the safe distance, and which greatly reduces the magnetic force between the shuttle and the magnetic force-generating element. In this case, to ensure the magnetic interaction between the shuttle and the magnetic force-generating means, it is necessary to use an expensive magnetic forcegenerating element with a greater magnetic force. As a result, the manufacturing and service costs of the loom are increased.

SUMMARY OF THE INVENTION

It is therefore the main object of this invention to provide a magnetically controlled loom with a sley which has a slot formed along the raceway whereby the distance between the shuttle and the magnetic forcegenerating element as well as the need to increase the magnetic force of the magnetic force-generating element are reduced, so as to decrease the manufacturing and service costs of the loom.

According to this invention, an improved sley is provided on a loom. The loom includes a reed assembly fixed on the sley, means for swinging said reed assembly to bite a strand of weft yarn into the shed of warp yarns, a raceway formed in the upper surface of said sley in front of said reed assembly, means for generating a magnetic force which moves along said raceway, and a shuttle attractable by said magnetic force to fly along said raceway. The sley is fixed on the swing arms of the swinging means. The magnetic force-generating means is disposed under the raceway. A slot is formed in the sley along the raceway. The bottom portion of the shuttle and/or the top portion of the magnetic force-generating means can extend partially into said slot so as to minimize the distance therebetween, thereby increasing the magnetic force therebetween.

BRIEF DESCRIPTION OF THE DRAWING

Other features and advantages of this invention will become apparent in the following detailed description of a preferred embodiment of this invention, with reference to the accompanying drawings in which.

DETAILED DESCRIPTION OF THE PREFERRED EMBODIMENT

Figure 1:
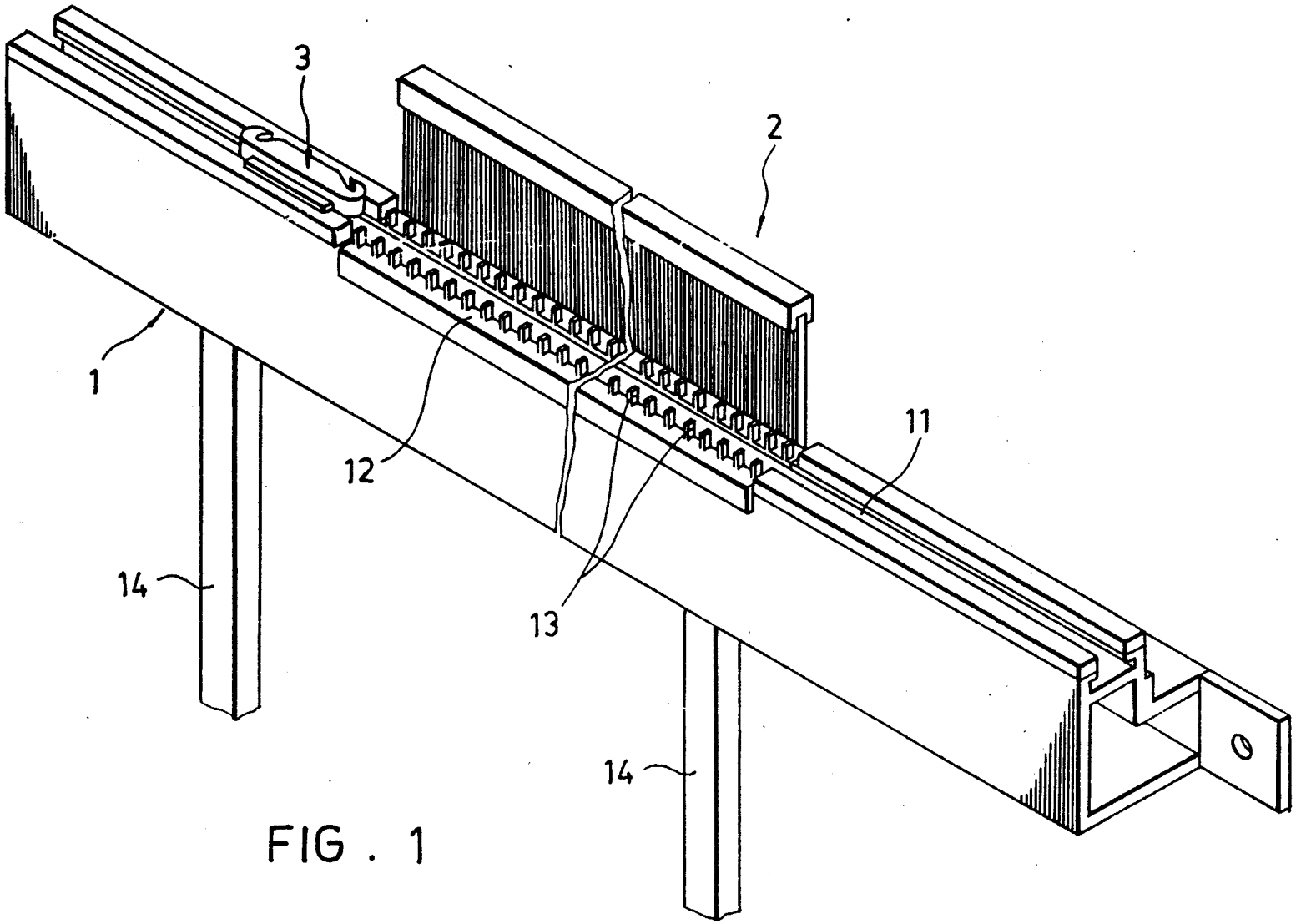
FIG. 1 is a perspective view of a sley for a loom according to this invention.

Referring to FIG. 1, a hollow sley 1 of this invention has a horizontally extending slot 11 formed in the upper wall thereof. A recess 12 is provided in the middle portion of the sley 1 in front of a reed assembly 2 which is fixed on the sley 1. A series of protrusions 13 are fixed in the recess 12 along the length of the sley 1. Any adjacent pair of protrusions 13 are spaced apart at an appropriate distance. The upper surfaces of the protrusions 13 are flush with the upper surface of the sley 1 so as to form a raceway along which a shuttle 3 can fly. A swinging mean includes two swing arms 14 which support the sley 1. When the swing arms 14 are swung, the reed assembly 2 bites a strand of weft yarn into the shed formed by warp yarns 50 (see FIG. 3).

Figure 2:
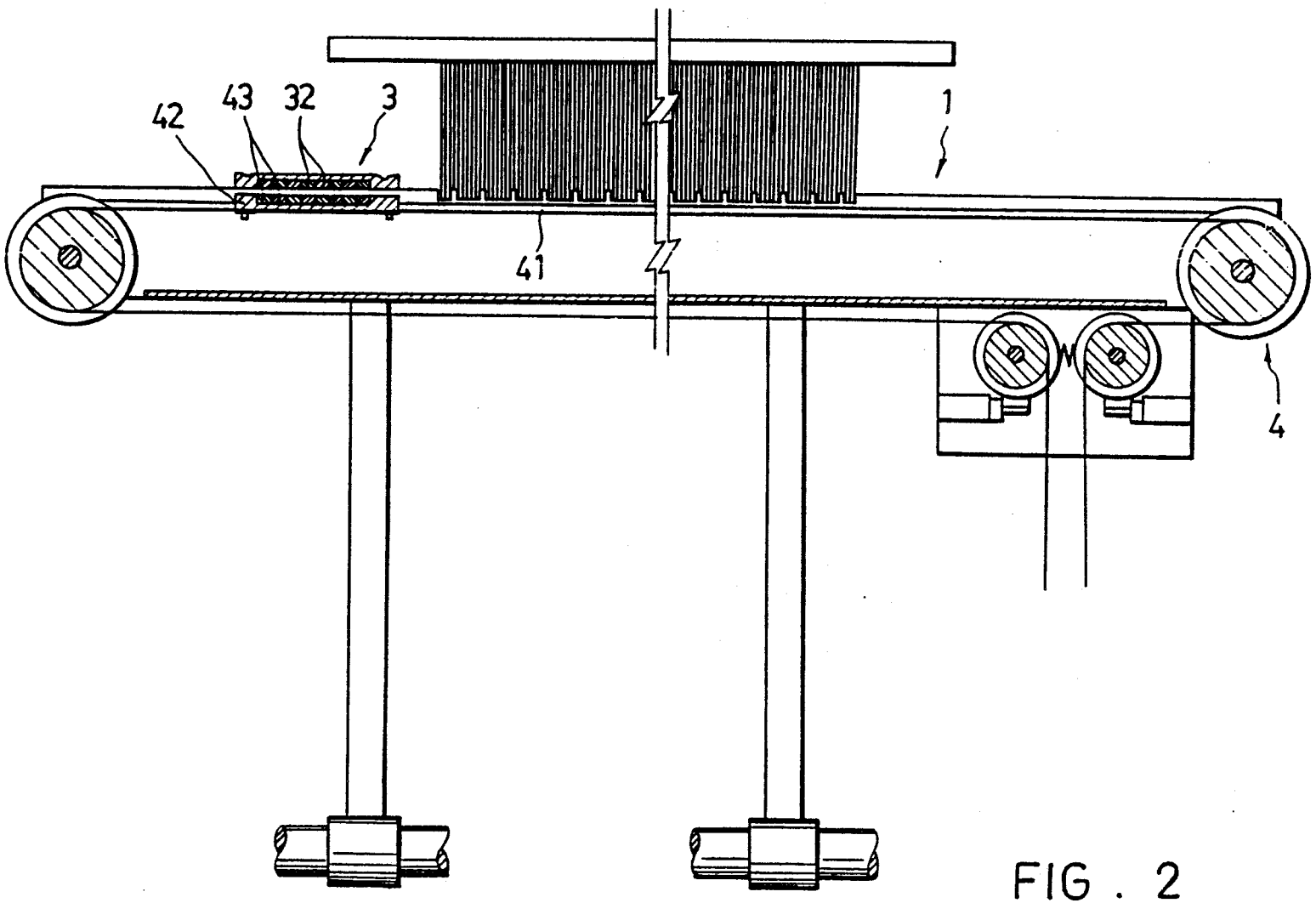
FIG. 2 is a schematic cross sectional view illustrating the magnetic force-generating means of the loom according to this invention.
Figure 3:
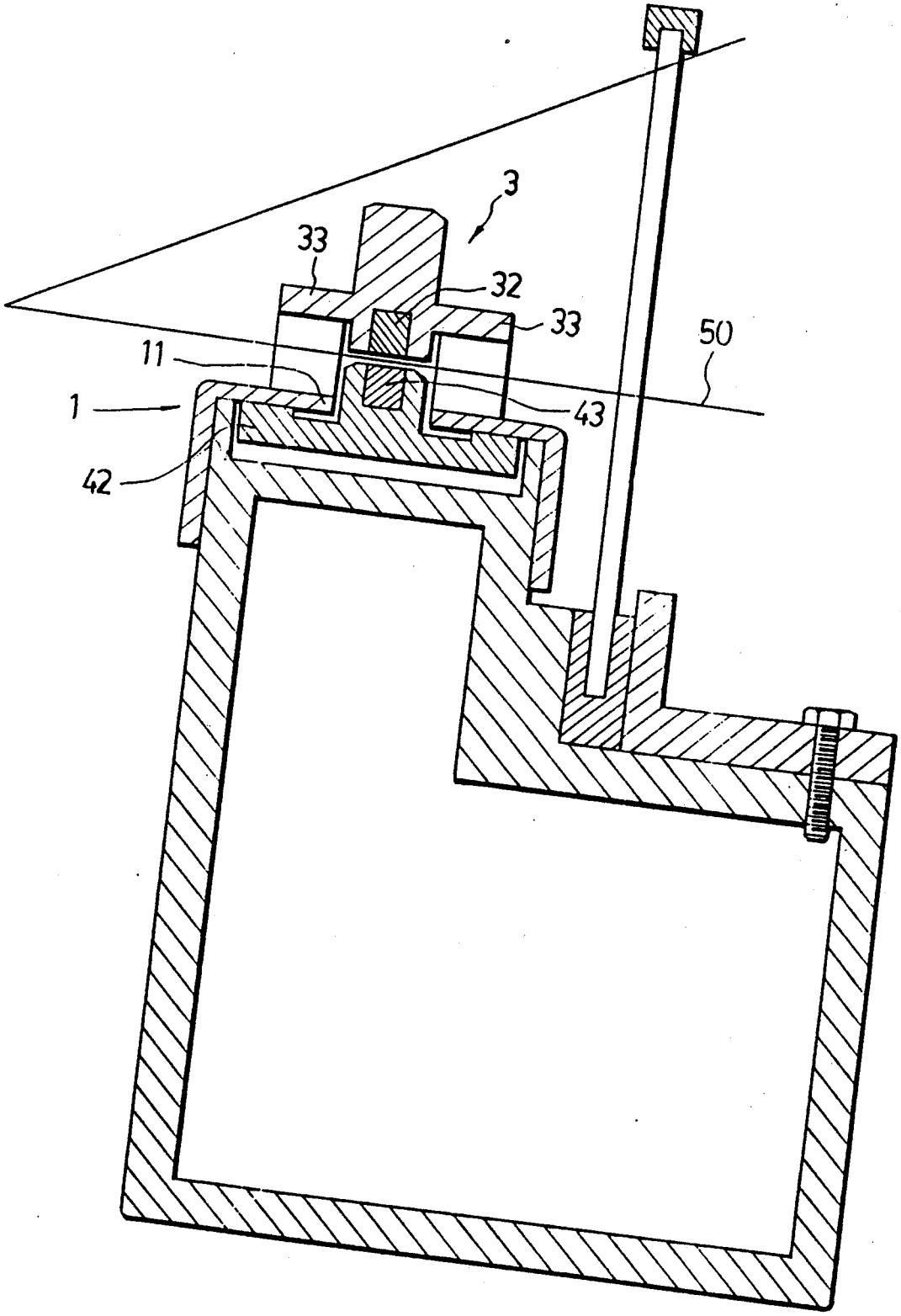
FIG. 3 is a schematic longitudinal sectional view illustrating the arrangement of the shuttle, the magnetic force-generating element and the slot of the loom in accordance with this invention.

Referring to FIGS. 2 and 3, a magnetic forcegenerating means 4 includes a reciprocating cable 41 which is disposed in the sley 1. A shuttle driving member 42 is secured to an appropriate position on the cable 41 and is provided at the upper end portion thereof with a magnetic force-generating element or magnet 43 which is aligned with the magnetic forcegenerating element (or magnet) 32 of the shuttle 3. When the cable 41 circulates reciprocally, the shuttle driving member 42 effects a linear reciprocating movement under the raceway so as to attract and drive the shuttle 3 to reciprocate.

As more clearly shown in FIG. 3, both the upper end of the shuttle driving member 42 and the bottom end of the shuttle 3 extend into the slot 11 in the sley 1. Two wings of the shuttle driving member 42 are positioned under the upper wall of the sley 1 so as to prevent the shuttle driving member 42 from moving upward out of the sley 1, while two side wings 33 of the shuttle 3 slide along the raceway which consists of the upper. Surfaces of the sley 1 and the protrusions 13. The space between the magnets 32, 43 can be reduced to a minimum degree as long as the lower layer of warp yarns 50 forming the shed can pass therethrough. According to this invention, the permissible minimum distance between the magnets 32, 43 is about 1–2 mm, which is much smaller than that of conventional looms which is about 10 mm. In other words, the need for the magnetic force of the magnets 32, 43 is reduced in accordance with this invention.

With this invention thus explained, it is apparent that numerous modifications and variations can be made without departing from the scope and spirit of this invention. It is therefore intended that this invention be limited only as indicated in the appended claims.

I claim:

1. A sley for a loom, said loom including a reed assembly fixed on said sley, means for swinging said reed assembly to bite a strand of weft yarn into the shed of warp yarns, a raceway formed in the upper surface of said sley in front of said reed assembly, means for generating a magnetic force which moves along said raceway, and a shuttle with-side wings attractable by said magnetic force to fly along said raceway, said sley being fixed on said swinging means, said magnetic force-generating means being disposed under said raceway, characterized in that a slot is formed in said sley, in such a manner that the bottom portion of said shuttle and/or the top portion of said magnetic forcegenerating means can extend partially into said slot, so as to minimize the distance therebetween, thereby increasing said magnetic force and a separate recess is provided in said sley on each side of the slot in front of said reed assembly with each said slot having spaced apart protrusions which extend to a location flush with the upper surface of the sley and over which said wings slide.

2. A sley as claimed in claim 1, wherein said slot is formed along said raceway.

* * * * *